United States Patent [19]

Derwent-Wryde

[11] 4,126,231

[45] Nov. 21, 1978

[54] STORAGE UNIT

[76] Inventor: Keith Derwent-Wryde, 13 Graham Rd., Purley, Surrey, England

[21] Appl. No.: 633,224

[22] Filed: Nov. 19, 1975

[30] Foreign Application Priority Data

Nov. 23, 1974 [GB] United Kingdom ..... 50825/74

[51] Int. Cl.[2] ..... A47F 5/08

[52] U.S. Cl. ..... 211/99; 108/29

[58] Field of Search ..... 211/94, 99, 100, 104; 312/315, 325; 248/291-294; 108/29

[56] References Cited

U.S. PATENT DOCUMENTS

| | | | |
|---|---|---|---|
| 1,204,010 | 11/1916 | Gore | 211/99 |
| 1,776,003 | 9/1930 | Levine | 211/99 |
| 2,471,349 | 5/1949 | Reiss | 211/99 |
| 2,518,370 | 8/1950 | Pincus et al. | 211/100 |
| 2,666,530 | 1/1954 | Beren | 211/99 |
| 3,211,295 | 10/1965 | Weiss | 211/100 |
| 3,417,874 | 12/1968 | Bryant | 211/100 |

FOREIGN PATENT DOCUMENTS

| | | | |
|---|---|---|---|
| 73,527 | 12/1951 | Denmark | 211/100 |
| 795,152 | 5/1958 | United Kingdom | 211/99 |

*Primary Examiner*—Roy D. Frazier
*Assistant Examiner*—Terrell P. Lewis

[57] ABSTRACT

A storage unit comprises a frame having a plurality of clothes hangers supported on a central member. The frame is provided with two support brackets and is hinged so that it can be moved from a lower, downwardly inclined position to an upper horizontally extending position to enable clothes to be stored in a small space and to be retrieved easily. Two struts maintain the frame in the upper position.

2 Claims, 2 Drawing Figures

STORAGE UNIT

BACKGROUND OF THE INVENTION

This invention relates to a storage unit, and more particularly, although not exclusively, to a storage unit suitable for storing clothes.

At the present time, in storing clothes, it is common to locate the clothes on clothes hangers, and to mount the clothes hangers on a rail provided in wardrobe or the like. If the rail is parallel to the wall forming the back of the wardrobe the wardrobe must have a depth, e.g. a front-to-back measurement, at least equal to the width of a clothes hanger. Alternatively, if the rail is extending away from the wall, and is horizontal, only a limited number of garments may be mounted on the rail on hangers. This is because the parts of the garments which are mounted on the hangers, e.g. the shoulders of jackets or coats, are made of may thicknesses of material, thus limiting the number of garments that can be mounted on a rail of predetermined length.

SUMMARY OF THE INVENTION

According to the present invention there is provided a storage unit comprising a support means; a member supported by the support means and movable between an extended position and a lowered position; means on the member to carry hangers at spaced locations in the extended position and the lowered position so that when the member is in the extended position or in the lowered position the hangers depend a d are spaced from one another; means for retaining the member in the extended position; and means for retaining the member in the lowered position at an acute angle to the vertical; the arrangement being such that items stored on the hangers are accessible when the member is in the extended position and occupy a lesser space when the member is in the lowered position.

Conveniently the hangers may be clothes hangers, although it will be appreciated that the hangers may be suspension members for charts, maps, or other data storage means, or even files.

In order that the invention may be more readily understood, and so that further features thereof may be appreciated, the invention will now be described by way of example with reference to the accompanying drawings.

DETAILED DESCRIPTION OF PREFERRED EMBODIMENT

Figure 1:
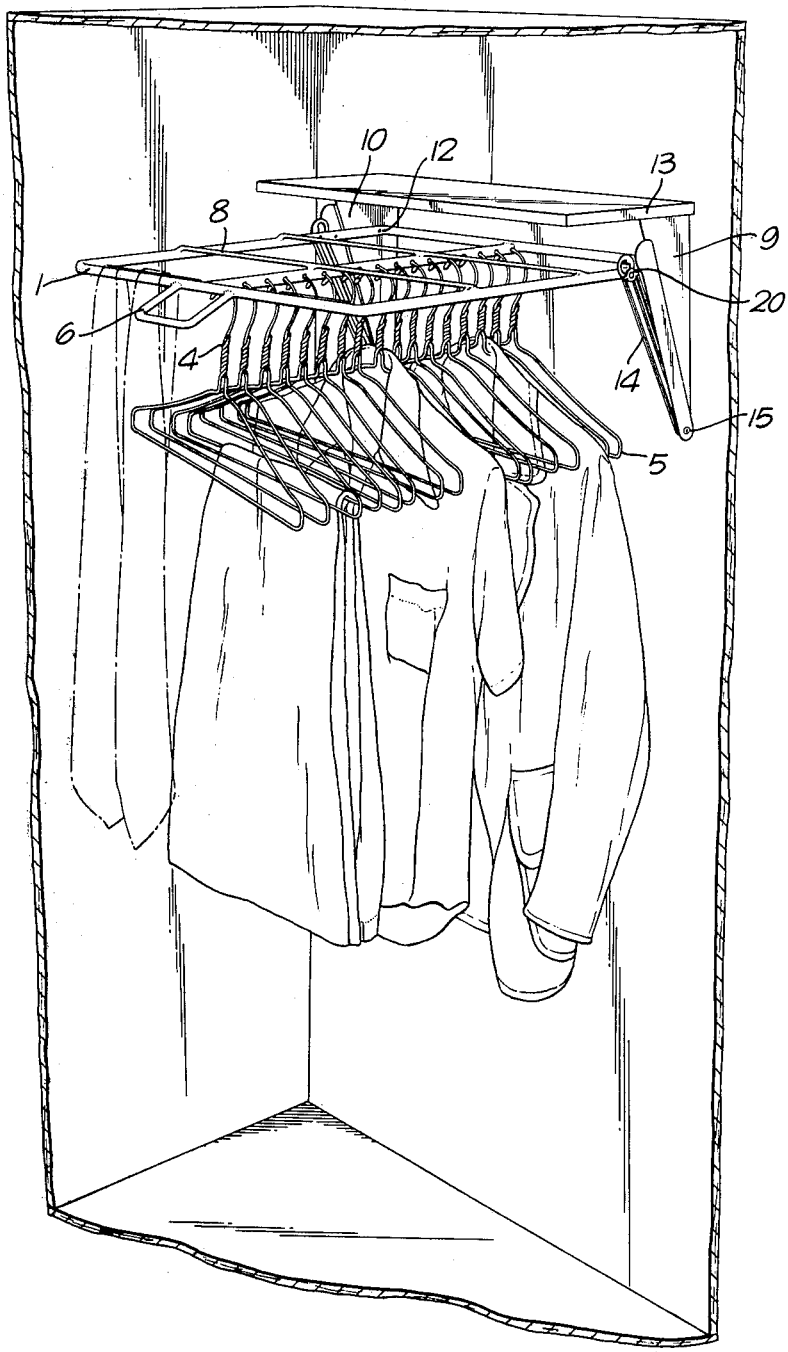
FIG. 1 is a perspective view of part of a wardrobe provided with a storage unit in accordance with the present invention, the frame of the storage unit being in the extended position.

Referring to the drawings a storage unit in accordance with the present invention, in the form of a storage unit for storing clothes, comprises a frame 1 which is of rectangular configuration and which is formed of metal strip or tubing coated with a plastic material. The frame 1 is provided with a longitudinal centre strip 2 which extends from the back of the frame towards the front of the frame. The strip 2 is provided with apertures 3 therein which are adapted to receive the hooks 4 of clothes hangers 5. It will be appreciated that the apertures 3 may be replaced by recesses formed in the upper part of the longitudinal strip 2 or by hooks provided below the longitudinal strip 2. Provided at the front of the frame is a handle 6 which is positioned so that it can be grasped readily by a person utilising the storage unit. Also provided on the frame are two further "U" shaped frame members 7 which are provided to enable the frame to accommodate ties or the like, and the frame is also provided with reinforcing strips 8 whih extend transversely of the centre strip and strengthen the frame and increase its load bearing capability.

It will be appreciated that the frame may be formed initially of a metal material, and then may be dipped to coat the frame with a plastics material.

A mirror may be provided (not shown) which may be secured to the top of the frame by channel members provided on the rear of the mirror which can resiliently engage two of said reinforcing strips 8.

Means are provided for pivotally supporting the frame, comprising two brackets 9, 10. The brackets are formed of metal and each comprise a flange 11 adapted to be secured to a wall by means of screws or bolts or the like. A portion of the support bracket extends forwardly from the flange 11, and the frame is pivotally connected to this portion of the support bracket by a pivotal connection device 12 which may be, for example, a rivet or the like. The top portion of each bracket, when the brackets are secured to a vertical wall or the like, is horizontal, and a shelf 13 may be mounted on the brackets.

Pivotally connected to the lower portion of each support bracket is a stay 14, which is connected to the bracket by means of a rivet 15 or the like. The stay 14 is formed of sheet metal and is an elongate member which extends generally upwardly from the rivet 15. The stay is formed with a longitudinal aperture there through, the longitudinal aperture having generally parallel sides, but having an arcuate terminal portion provided in a disc shaped terminal portion of the stay. The portions of the stay adjacent the side walls of the aperture are turned upwardly so that this portion of the stay has a channel-like configuration.

Two lugs are provided on the frame 1 and these lugs are provided with rotary head members 20 which engage with the stay 14. Each stay 14 is mounted in a recessed part of the bracket 9 or 10. The stay engages with the thus defined shoulder *9a*, *10a* to limit movement of the stay.

With the frame in the position illustrated in FIG. 1, the hangers 5 depend from the frame 1 and are spaced apart, thus enabling hangers to be removed readily from the frame, or enabling items of clothing to be removed readily from the hangers. With the frame in this position protrusions on the head member 20 engage with the end of the channel-like portion of the stay 14, thus retaining the frame in position. When it is desired to lower the frame, the handle 6 is grasped and the frame is pivoted slightly upwardly until pin provided on the lower surface of the rotary head 20 engages the arcuate portion of the aperture through the stay, and the rotary head will be moved so that the protrusions thereon are generally aligned with the axis of the aperture 16 provided in the lug.

Figure 2:
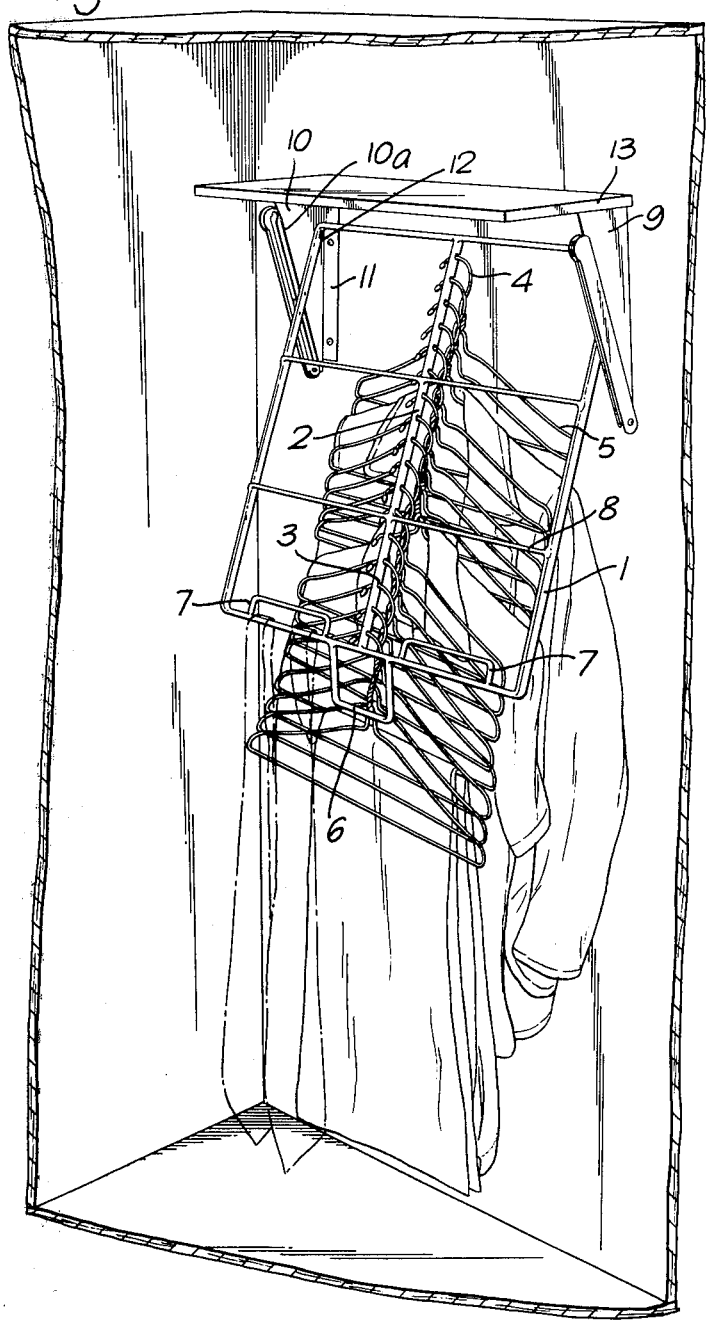
FIG. 2 is a perspective view corresponding to FIG. 1 showing the frame in the lowered position.

The frame 1 may then be lowered towards the position shown in FIG. 2 and it can be seen that the head 20 will slide along the channel-like portion of the stay, until the stays engage with the shoulders provided on the brackets and thus downward movement of the frame is limited.

With the frame in the lowered position, items of clothing stored on the hangers will be spaced apart, since the hangers are retained in position on the frame, and will occupy a minimum amount of space since the parts of the garments mounted on the hangers will be "staggered" relatively to each other, and it can be seen that the front of the frame will be located below the front edge of the shelf 13. Thus it will be appreciated that the device may be mounted in a wardrobe or the like, and the doors of the wardrobe may be mounted so that, when they are closed, they are located immediately in front of the shelf 13. Then when a person wishes to retrieve an item of clothing from the storage unit, the doors of the wardrobe are opened, and the frame is raised, the forward part of the frame then extending out of the front of the wardrobe.

Whilst the invention has been described with reference to a specific embodiment in which clothes are to be stored it will be appreciated that the hangers may be suspension members for charts, files, maps etc., and thus the invention may find application in the realm of office furniture.

Furthermore it will be appreciated that the storage unit need not be mounted in a wardrobe, but may be a free fitting mounted in an alcove or on a wall, and may be surrounded, if desired, by a curtain.

In the embodiment illustrated items of clothing may be stored on seventeen hangers, and when the frame is lowered the horizontal distance from the wall supporting the frame to the front of the frame is nine inches. It will be appreciated that this represents very efficient utilization of space, and thus storage units in accordance with the invention will be of special use where storage space is limited e.g. in small flats, boats, caravans or the like.

What is claimed is:

1. A storage unit comprising a support means, a movable, substantially rectangular frame supported by the support means and movable thereon between an extended position and a lowered position, a central member extending across the frame, means to carry hangers at spaced locations on said member, and operative both when the frame is in its extended position and in its lowered position, to support the hangers so that they depend from, and are spaced from one another on, said member, stay means for releasably retaining the frame substantially horizontal, when in said extended position; and retaining means provided on the support means for retaining the frame, when in said lowered position, at an acute angle to the vertical, the arrangement being such that items stored on the hangers are disposed in spaced, horizontal registry to be readily accessible, when the frame is in its extended position, and are positioned in inclined, overlapping relation so as to occupy a lesser space, when the frame is in its lower position, said support means being provided with a pair of spaced, pivoted stays, and said frame having lugs protruding from opposite sides thereof slidably into apertures provided in said stays, the stays and lugs constituting said means for retaining the frame in an extended position.

2. A storage unit according to claim 1, wherein said aperture in each stay is an elongate slot having a channel-like portion in one end, and each lug is provided with a rotary head having two radial protrusions, the protrusions being engageable with the ends of the channel-like portions of the stays to retain the frame in its extended position, each head being rotatable by the engagement of pins provided on the head with a portion of the aperture provided in the stay to enable the frame to be lowered.

* * * * *